US005380223A

United States Patent [19]

Marsh et al.

[11] Patent Number: 5,380,223

[45] Date of Patent: Jan. 10, 1995

[54] HIGH DENSITY ELECTRICAL CONNECTOR

[75] Inventors: Edward K. Marsh, Kernersville; Terry L. Pitts, Greensboro; Randy G. Simmons, Lewisville, all of N.C.

[73] Assignee: The Whitaker Corporation, Wilmington, Del.

[21] Appl. No.: 158,127

[22] Filed: Nov. 24, 1993

[51] Int. Cl.[6] ..... H01R 13/648

[52] U.S. Cl. ..... 439/610; 439/904; 439/357

[58] Field of Search ..... 439/607–610, 439/350, 351, 357, 358, 904, 906

[56] References Cited

U.S. PATENT DOCUMENTS

| | | | |
|---|---|---|---|
| 4,579,404 | 4/1986 | Lockard . | |
| 4,602,831 | 7/1986 | Lockard . | |
| 4,641,902 | 2/1987 | Fusselman . | |
| 4,653,836 | 3/1987 | Peele . | |
| 4,871,319 | 10/1989 | Babow | 439/77 |
| 4,941,848 | 7/1990 | Philippson et al. | 439/607 |
| 4,981,447 | 1/1991 | Ichitsubo | 439/607 |
| 5,116,245 | 5/1992 | Baker | 439/581 |
| 5,162,000 | 11/1992 | Frantz | 439/607 |
| 5,169,346 | 12/1992 | Johnston | 439/607 |
| 5,171,161 | 12/1992 | Kachlic | 439/352 |
| 5,195,909 | 3/1993 | Huss, Jr. et al. | 439/465 |
| 5,199,903 | 4/1993 | Asick et al. | 439/610 |
| 5,203,717 | 4/1993 | Beck et al. | 439/460 |
| 5,211,578 | 5/1993 | Henschen et al. | 439/494 |
| 5,236,375 | 8/1993 | Kachlic | 439/607 |

*Primary Examiner*—Gary F. Paumen
*Assistant Examiner*—Hien D. Vu
*Attorney, Agent, or Firm*—William B. Noll

[57] ABSTRACT

This invention relates to a high density shielded electrical cable connector receptacle of the type for the transmission of signals from PCMCIA cards to network wiring. The receptacle comprises a housing insert for mounting a plurality of electrical contacts, a pair of hermaphroditic, metal shielding members adapted to lie contiguous with the housing insert, and a dielectric cover member for receiving the assembled housing insert and shielding members. The housing insert comprises a dielectric, elongated, first housing member having a connector mating portion, and a rear insert receiving portion, and a dielectric insert for receipt in the insert receiving portion. The dielectric insert includes an elongated opening through which first ends of the electrical contacts may project, and a rear contact divider characterized by a plurality of axially extending ribs along the upper and lower surfaces of said dividers, where the respective upper and lower ribs are staggered and that the opposite ends of adjacent electrical contacts are alternately arranged between adjacent ribs on the upper and lower surfaces of the divider.

9 Claims, 5 Drawing Sheets

HIGH DENSITY ELECTRICAL CONNECTOR

BACKGROUND OF THE INVENTION

The present invention is directed to a high density, shielded, electrical cable connector receptacle of the type for mating with a header connector, which, as known in the art, may be mounted on a printed circuit board. The invention hereof is particularly concerned with a low profile connector offering closely spaced, planarly arranged contacts, typically less than 1 mm center-line spacings. In addition to this need for high density, the requirement for effective electrical shielding remains. This is a particular concern with the drive for miniaturization in the field of telecommunications and data transmission equipment, and the risks associated with cross-talk problems. The present invention address these concerns with a connector design that uses a unique contact divider which allows for close center-line spacing of contacts, while providing ample space for terminating the contacts, such as by soldering.

U.S. Pat. No. 4,653,836 is directed to a shielding connector of the type to which a cable may be terminated However termination therein is by insulation displacement which is not amenable to high density, or small center-line termination, as may be achieved by a staggered termination technique. U.S. Pat. No. 4,602,831, directed to an electrical plug connector, teaches the concept of having signal contact members secured to one side of a contact-carrying member at spaced intervals therealong, while a ground contact member is secured to the other side of the contact-carrying member. Notwithstanding this approach, space is still at a premium.

Again, the present invention offers a unique approach to providing a high density, single row of terminated contacts for a shielded, electrical cable connector receptacle. Such approach will become apparent to those skilled in the art, particularly from the description which follows, when read in conjunction with the accompanying drawings.

SUMMARY OF THE INVENTION

This invention relates to a high density shielded, electrical cable connector receptacle of the type for mating with a complementary electrical connector. The receptacle comprises a housing insert for mounting a plurality of electrical contacts, a pair of hermaphroditic, metal shielding members adapted to lie contiguous with the housing insert, and a dielectric cover member for receiving the housing insert and shielding members.

The housing insert comprises a dielectric, elongated, first housing member having a connector mating portion, and a rear insert receiving portion, and a dielectric insert for receipt in the insert receiving portion. The dielectric insert includes an elongated opening through which first ends of the electrical contacts may project, and a rear contact divider characterized by a plurality of axially extending ribs along the upper and lower surfaces of the divider. The respective upper and lower ribs along the divider surfaces are staggered such that the opposite ends of adjacent electrical contacts are alternately arranged between adjacent ribs on the upper and lower surfaces of the divider.

DETAILED DESCRIPTION OF PREFERRED EMBODIMENTS

Figure 1:
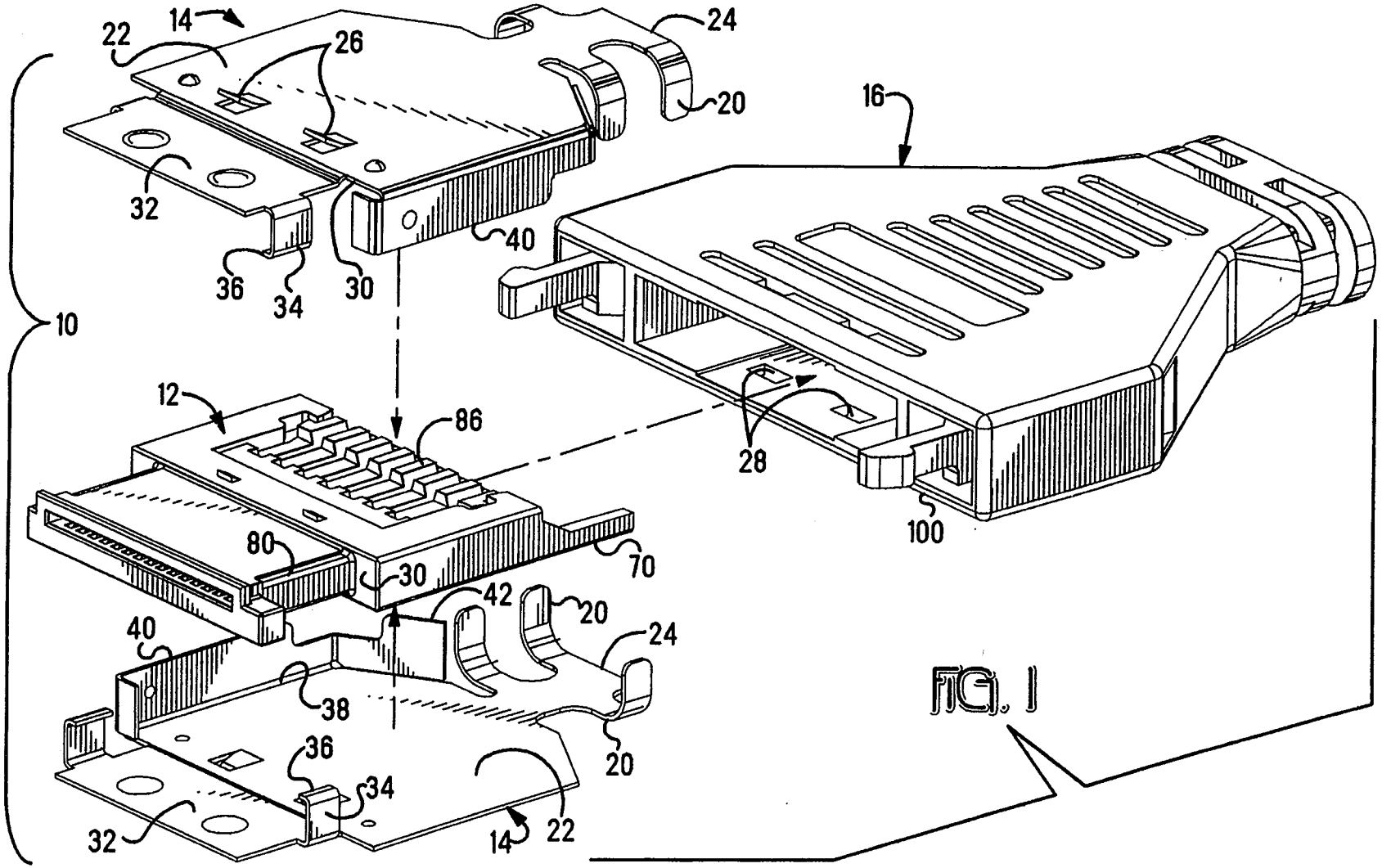
FIG. 1 is an exploded perspective a view of the various components forming the high density electrical cable connector receptacle according to this invention.

FIG. 1 illustrates the various components forming the preferred connector 10 of this invention, more particularly a high density, shielded electrical cable connector receptacle of the type for mating with a complementary connector, such as a header connector, as known in the art. Accordingly, no complementary mating connector is illustrated in the drawings.

The preferred connector 10 of this invention comprises a housing insert 12 for mounting a plurality of stamped and formed electrical contacts, to be described hereinafter, a pair of hermaphroditic, stamped metal shielding members 14, to be wrapped about or lie contiguous with said housing insert 12, and a dielectric cover member 16 to receive the assembled shielding members and housing insert in latching engagement therewithin. What is not illustrated in the several figures is a multi-conductor shielded cable which is terminated in the assembled connector. Typically, such cable, as known in the art, comprises a plurality of conductors, a braided shield thereabout, where the cable is stripped at the end to allow termination of the individual conductors in a manner to be described hereinafter, and the braided shield is exposed away from the end to be crimped between the ears 20 of the mated and aligned shielding members 14 to effect grounding thereof.

The respective shielding members 14, essentially identical in configuration, are stamped and formed from a sheet metal blank. Each such member comprises a primary body portion 22, with a tail 24 extending therefrom. Projecting laterally and formed in a arcuate fashion are the crimping ears 20 for crimping about the cable or metal braid thereabout, in a manner known in the art. The body portion 22 further includes a pair of lances 26 struck from the metal which engage complementary holes 28 or recesses in the dielectric housing member 16. Projecting from the opposite end 30 of the body portion 22 is a stepped portion 32, where a pair of latching side wall portions 34 are provided. Each such wall portion 34 includes an inturned end 36 for engaging and interconnecting with the other shielding member 14 when joined about the housing insert 12. Finally, along the side 38 of each body portion 22 are upstanding wall sections 40, 42, which, when coupled with the latching side wall portions 34, provide essentially continuous shielding along the respective sides of the mated shielding members 14.

Figure 2:
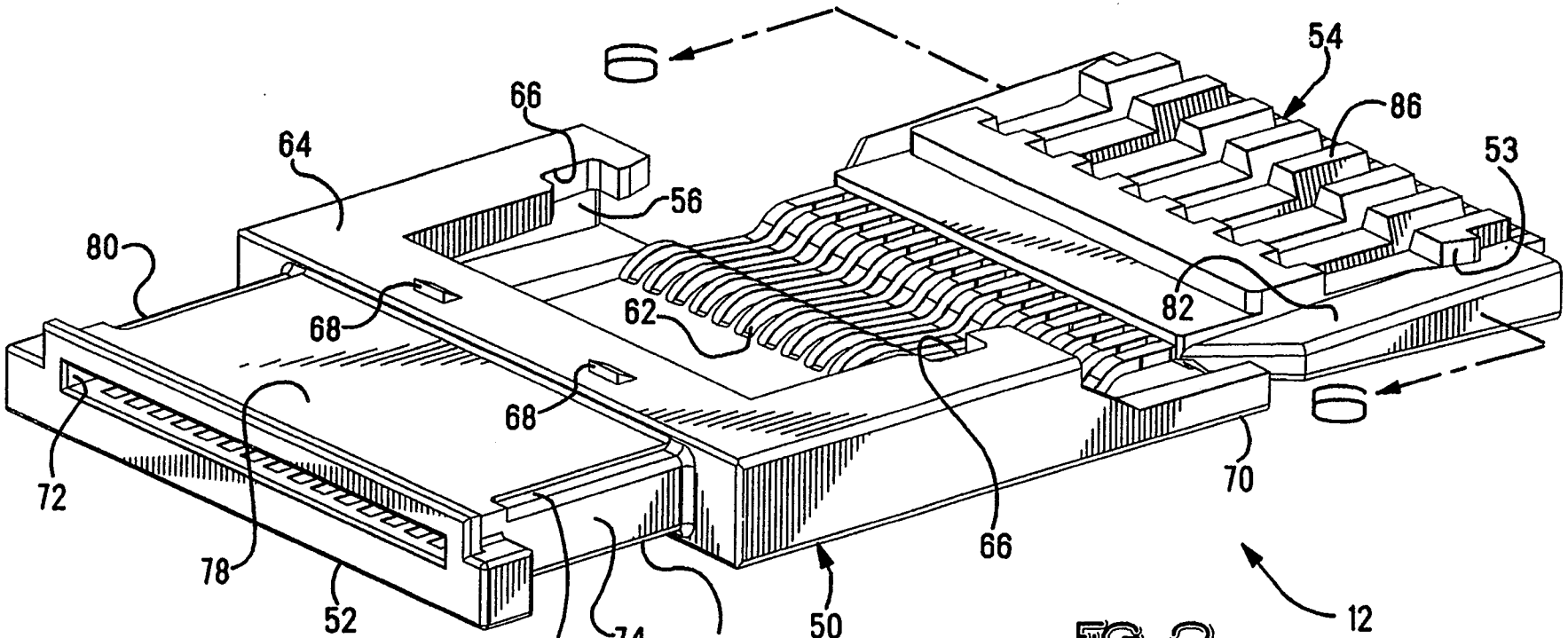
FIG. 2 is an exploded perspective view of a housing insert to contain the planarly aligned electrical contacts, for receipt in the connector receptacle of this invention.
Figure 3:
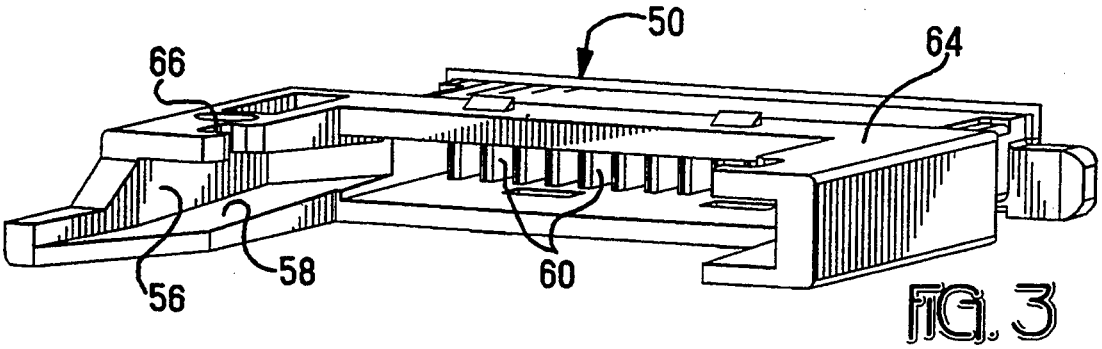
FIG. 3 is an inside perspective view of a housing member forming one part of the housing insert of FIG. 2.
Figure 4:
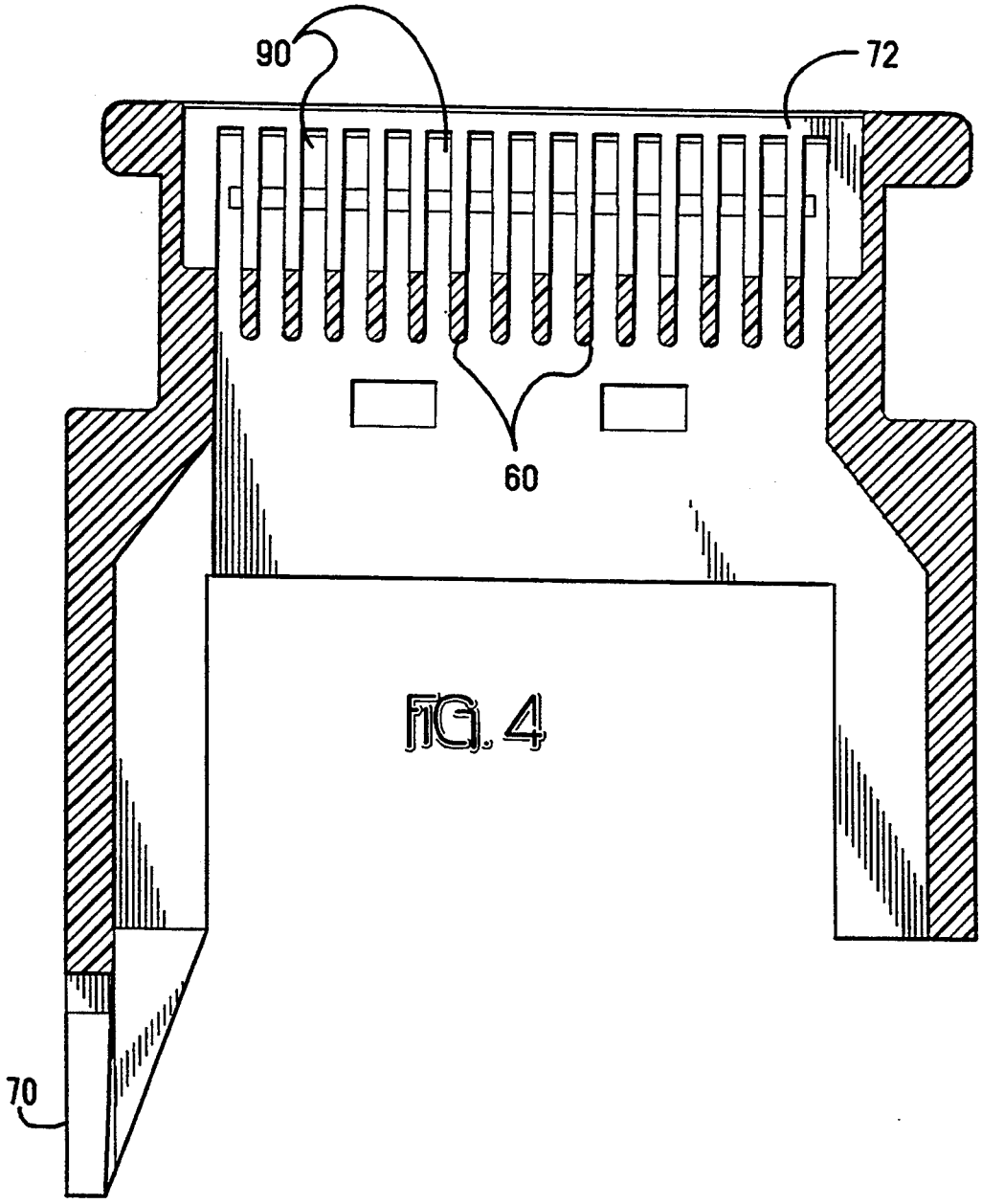
FIG. 4 is a longitudinal sectional view taken through the housing insert illustrated to the right of FIG. 2.

The housing insert 12, which lies within or between the mated shielding members 14, the two separate components thereof being illustrated in FIG. 2, comprises a U-shaped housing portion 50, a forward connector mating portion 52, and a contact mounting member 54 insertable into the housing portion 50. The U-shaped housing portion, as best seen in FIG. 3, includes a pair of side channels 56 for slidably receiving the contact mounting member 54. The channel 56 includes a tapered lower surface 58 to guide member 54 into proper seating engagement therein. Internally, the housing portion 50 includes a plurality of contact dividers 60 between which the contacts 62 are received. Further, along the upper wall 64 of the channels 56, a pair of opposing indents or recesses 66 are provided, where such indents or recesses 66 are arranged to receive, by snap engagement, complementary projections on the contact mounting member 54, as hereinafter explained. Finally, pairs of ramped projections 68 may be provided on the respective upper and lower surfaces of the housing portion 50, where the placement of said projections coincide with the lances 26 on the shielding members 14. Optionally, an alignment or polarizing extension 70 may be provided along the rear of the housing portion 50 to insure proper aligning and mating of the respective components.

Projecting forwardly of the housing portion 50 is the connector mating portion 52. Such mating portion includes a central opening 72 in communication with the exposed contacts 62 to allow electrical mating therewith by a complementary electrical connector, not shown. At the intersections of the side walls 74 and the respective upper and lower faces 76, 78, tab engaging channels 80 are provided. Such channels are adapted to receive the inturned ends 36 of the respective shielding members 14.

Figure 5:
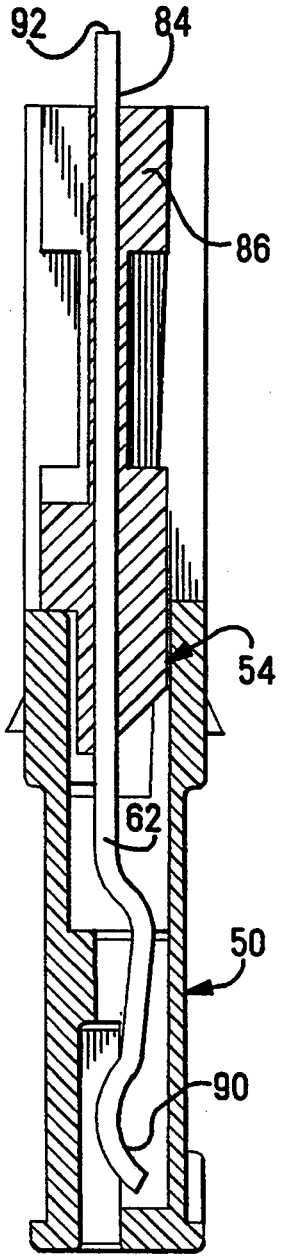
FIG. 5 is a lateral sectional view taken through the assembled housing insert and contact mounting member of FIG. 2.
Figure 6:
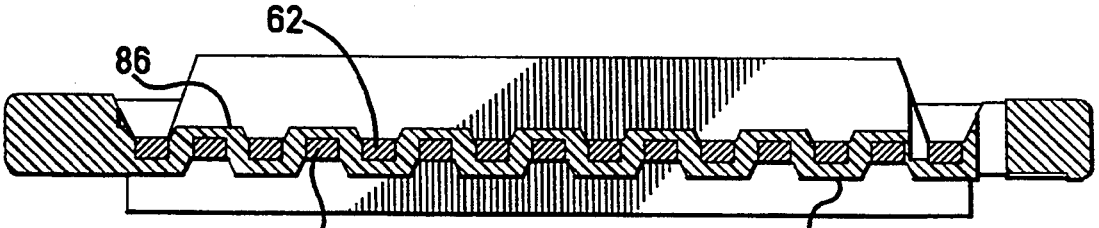
FIG. 6 is a sectional view taken along line 6—6 of FIG. 2.

The contact mounting member 54, to be slidably received within the channels 56 of housing portion 50, comprises a dielectric housing 82 having contact receiving through openings 84, see FIG. 5. Disposed along the respective upper and lower faces are a plurality of axially arranged ribs 86, where the ribs along the upper face are axially staggered from those on the lower face, see FIG. 6. In other words, the valleys between adjacent ribs of one face are vertically aligned with the ribs on the other face. Additionally, each said valley is laterally aligned with one another, and are in communication with the through opening 84. By this arrangement, as the contacts 62 are loaded therein, adjacent contacts enter jointly into the through opening 84, then individually into a respective upper or lower valley between ribs. It will be seen that while the contact ends 90 are closely spaced by a narrow center-to-center spacing, the opposite ends 92 are in effect spaced apart by an amount of twice such spacing. This is important to have sufficient room for soldering the opposite ends to selected conductors in the cable. With the contact end 92 suitably arranged between a pair of ribs, a spot of solder and a cable conductor are placed thereover, followed by heating to effect a soldered electrical connection between the contact and its corresponding cable conductor. By the use of this staggered arrangement at the solder ends of the contacts, ample space is provided for soldering while assuring that shorting between adjacent contacts is avoided.

Figure 7:
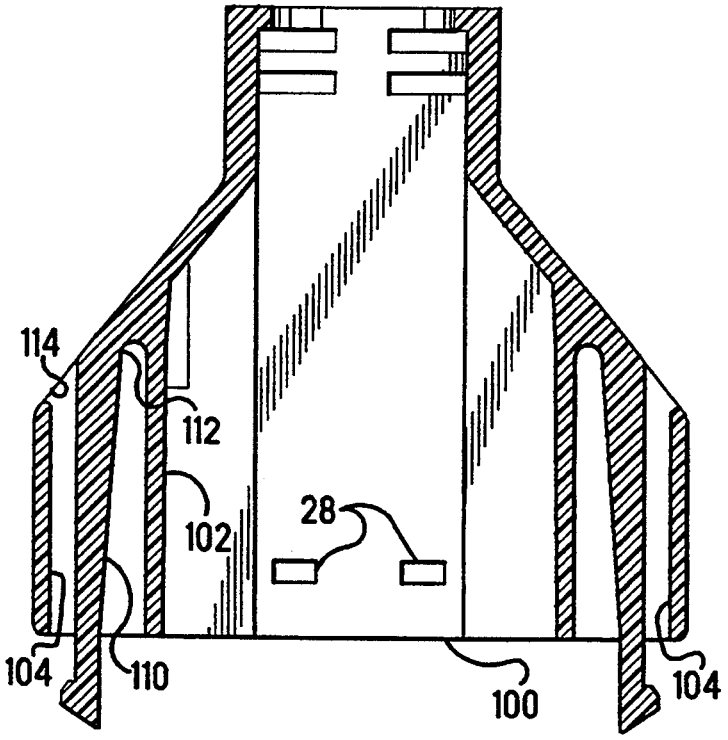
FIG. 7 is a lateral sectional view of a first embodiment for the cover member of this invention.

The final component hereof is the dielectric cover member 16 for receiving the assembled and shielded housing insert 12. A first embodiment of the cover member 16 is illustrated in FIG. 1 and 7. Such embodiment shows a cover member having a mating face 100, a central chamber 102 for receiving the shielded and assembled housing insert 12, and two side chambers 104. Communicating with said central chamber 102, along the upper and lower faces of the cover member, are pairs of latch receiving openings 28 to receive in latching engagement the lances 26. At the rear end thereof, where the sides converge to correspond to the shape of the shielded and assembled housing insert 12, a cable opening 108 is provided in through which the multi-conductor is received.

The latching of the cover member 16 to a complementary electrical connector is achieved by means associated with the respective side chambers 104. In the embodiment of FIG. 7, a free standing locking arm 110 is integrally molded at end 112 to the chamber wall 114. By this arrangement, the locking arm 110 may be laterally flexed to engage, or disengage, a complementary notch or shoulder on the mating part as known and practiced in the art.

Figure 8:
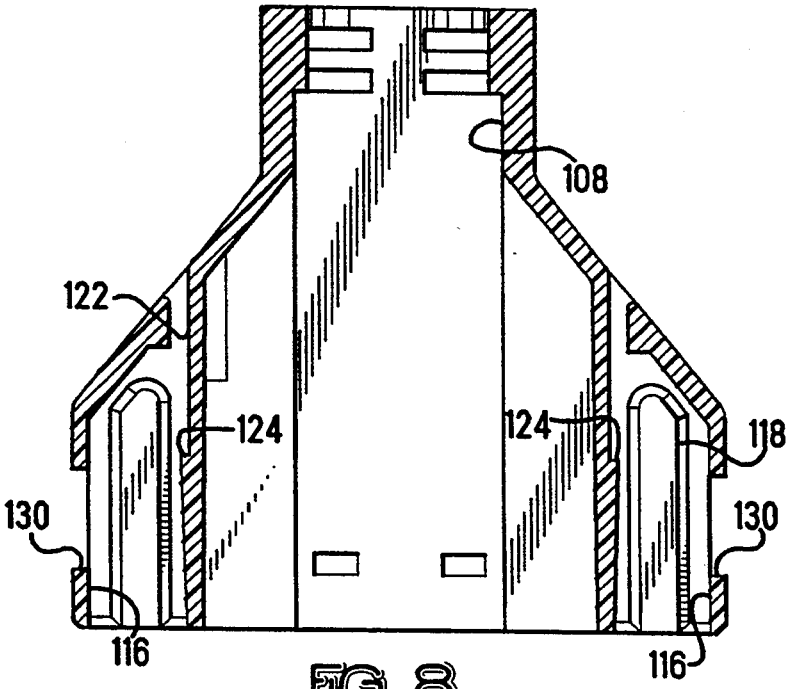
FIG. 8 is a lateral sectional view, similar to FIG. 7, illustrating a second embodiment for the cover member.
Figure 9:
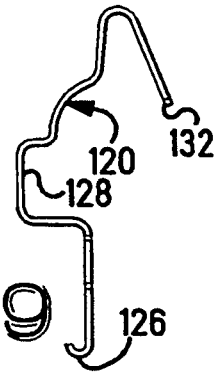
FIG. 9 is a plan view of a formed metal spring member, insertable into the cover member of FIG. 8, which is used to effect latching to a complementary connector housing.

As an alternate to the embodiment of FIG. 7, a different type of latching mechanism may be employed, see FIGS. 8 and 9. The side chamber 116 has been modified by the inclusion of a partial wall support 118 about which the formed spring metal arm 120 seats. That is, the metal arm 120 may be positioned therewithin by moving such arm over the wall support 118, then downwardly about and in supporting engagement with the wall support 118. The inner wall 122 of the chamber includes a stepped portion 124, the purpose of which will become apparent hereinafter.

The metal arm 120 is formed within a plane in the manner illustrated in FIG. 9. Such arm includes a connector engaging end 126, and an intermediate formed section 128 which projects through a window 130 in the chamber wall, whereby pushing of such section 128 will allow for engaging and disengaging of the cover member 16 from a complementary electrical connector. To help secure the metal arm 120 therewithin, the remote end 132 is arranged to seat against the stepped portion 124.

We claim:

1. A high density electrical cable connector receptacle of the type for mating with a complementary electrical connector, said receptacle comprising a housing insert for mounting a plurality of electrical contacts, a pair of identical, metal shielding members adapted to lie contiguous with said housing insert, and a dielectric cover member for receiving said housing insert and shielding members, said housing insert comprising a dielectric, elongated, first housing member having a connector mating portion, and a rear insert receiving portion, and a dielectric insert for receipt in said rear insert receiving portion, where said dielectric insert includes an elongated opening through which first ends of said electrical contacts may project, and a rear contact divider characterized by a plurality of axially extending ribs along the upper and lower surfaces of said divider, where the respective upper and lower ribs are staggered and that the opposite ends of adjacent said electrical contacts are alternately arranged between adjacent ribs on said upper and lower surfaces of said divider.

2. The high density electrical cable connector receptacle according to claim 1, wherein valleys between adjacent side-by-side ribs are opened into said elongated opening.

3. The high density electrical cable connector receptacle according to claim 2, wherein said valleys along said upper and lower surfaces are aligned in a common plane.

4. The high density electrical cable connector receptacle according to claim 1, wherein said first housing member includes a plurality of vertically aligned, spaced-apart wall dividers, whereby each said contact is aligned between a pair of adjacent wall dividers.

5. The high density electrical cable connector receptacle according to claim 4, wherein said first housing member comprises a connector mating portion having a pair of side extensions, parallelly arranged to receive said dielectric insert therebetween, where said extensions include channels for slidably receiving said dielectric insert.

6. The high density electrical cable connector receptacle according to claim 1, wherein said dielectric cover member includes a central chamber for receiving said housing insert and shielding members, and a pair of side chambers having means therein for latchedly engaging a complementary electrical connector to be mated therewith.

7. The high density electrical cable connector receptacle according to claim 6, wherein said means includes a laterally flexing arm integrally joined at one end thereof to a wall of said side chamber, said arm including a free end having a latching tab.

8. The high density electrical cable connector receptacle according to claim 6, wherein said means includes a pair of formed, spring metal members, and each of said side chambers includes a window therein through which a portion of one said spring metal member projects, whereby said portion is accessible to effect mating and unmating with said complementary electrical connector.

9. The high density electrical cable connector receptacle according to claim 6, wherein said dielectric cover member includes at least one lance receiving slot for receiving a lance to latchedly secure said housing insert and shielding members therewithin.

* * * * *